United States Patent [19]

Wood

[11] 4,213,548

[45] Jul. 22, 1980

[54] INSULATIVE WIDE STYLE WATCHBAND

[76] Inventor: Bruce G. Wood, 6867 Mission Gorge Rd., San Diego, Calif. 92120

[21] Appl. No.: 923,180

[22] Filed: Jul. 10, 1978

[51] Int. Cl.[2] ..... G04B 37/14; A44C 5/00

[52] U.S. Cl. ..... 224/168; 2/DIG. 6; 224/180

[58] Field of Search ..... 224/4 D, 4 E, 4 A, 4 B, 224/4 C, 5 C, 5 R, 26 R, 5 H, 28 W, 28 B, 28 R, 168, 164, 175, 177, 178, 180; 2/DIG. 6; 58/105; D10/32; D11/3; 24/265 WS

[56] References Cited

U.S. PATENT DOCUMENTS

| | | | |
|---|---|---|---|
| D. 92,018 | 4/1934 | Pracht | D11/3 |
| D. 240,649 | 7/1976 | Ashworth | D11/3 |
| 2,513,782 | 7/1950 | Berkeley | D11/3 X |
| 3,991,921 | 11/1976 | Hirsch | 224/4 D |
| 4,047,651 | 9/1977 | McMullen | 224/4 D |

FOREIGN PATENT DOCUMENTS

| | | | |
|---|---|---|---|
| 466443 | 7/1950 | Canada | 224/4 D |
| 971814 | 1/1951 | France | 224/4 D |
| 619116 | 3/1949 | United Kingdom | 224/4 D |

*Primary Examiner*—Robert J. Spar
*Assistant Examiner*—Jerold M. Forsberg
*Attorney, Agent, or Firm*—Roy L. Knox

[57] ABSTRACT

A watchband which is insulative against static electricity and which is characterized by having a relatively wide band upon which a wrist watch may be supported by a strap much narrower than the band and having wrist watch pin-retaining loops projecting through the band, the entire item being constructed of the material currently merchandised under the trademark VELCRO.

2 Claims, 4 Drawing Figures

INSULATIVE WIDE STYLE WATCHBAND

BACKGROUND OF THE INVENTION

Watchbands in the prior art have mostly been of a width substantially equal to the length of the lateral retaining pins of the wrist watch being supported, but some prior bands, especially those constructed of leather, have been wider with pin-retaining loops stitched to the face of the band. It is also recognized that the material called "Velcro" has been adapted to bands for various uses usually with a square link or the like permitting an end portion of the band or strap to be returned for fastening. There is a need for a wide watchband that can be manufactured economically.

SUMMARY OF THE INVENTION

As claimed, the hereindisclosed watchband comprises a wide band which fastens on a user's wrist without buckle or link structure and which has a relatively narrow strap engaging the wrist watch, the strap being secured at the ends to the inside of the band and having spaced loop portions extending to the outside of the band.

DETAILED DESCRIPTION OF A PREFERRED EMBODIMENT

Figure 1:
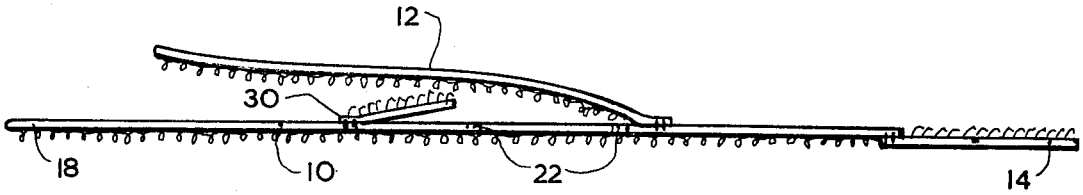
FIG. 1 is a longitudinal sectional view of the extended watchband with the watch retaining strap withdrawn from the spaced slit openings in the band, and disconnected from the tab which normally holds one end of the strap.
Figure 2:
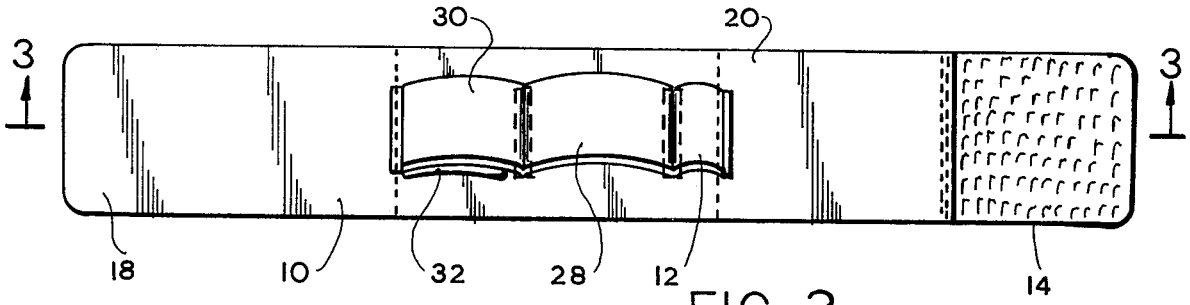
FIG. 2 is a plan view of the extended watchband as viewed from the inside of the band as used.
Figure 3:
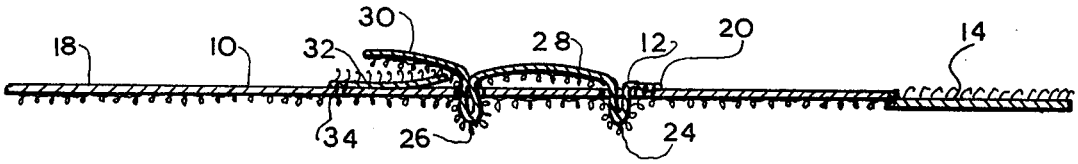
FIG. 3 is a view, similar to FIG. 1 but with the strap looped through the spaced slit openings.

Referring now to the drawing, wherein like numerals refer to like identical elements throughout the different views, this watchband comprises a band 10 and a strap 12. The band 10 is much wider than the strap 12 and is also much longer. The relatively wide band 10 and the strap 12 both serve to insulate the watch from the static electricity of the user's body. As illustrated, all portions of the watchband are constructed of the dual form material merchandised under the trademark VELCRO, with two mating types of fasteners, which may be termed a myriad of hooks and a myriad of loop-like eyes on the two different parts of the dual material. As used in this invention the band 10 has the myriad loop-like eyes disposed outwardly as the wristband is used with the result that the wristband has the outward appearance and feel of velvet. One end portion 14 of the band 10 has a short length of the other type of fasteners, that is, that with the myriad of hooks, the hooks being disposed on what will be considered the inside of the band. This end portion 14 is secured to the main portion of the band as indicated at 16, and of course is used for releasibly fastening the two end portions 14 and 18 of the band in the form of a bracelet as indicated in FIG. 4.

The strap 12 is constructed of the same material as the main portion of the band 10 and disposed in the same directional sense with the side having the loop-like eyes outward. One end of the strap 12 is secured, as by stitching 20, to the inside of the band, or so-called "welding" may be used.

A pair of opposed, spaced slits 22 are provided in the central portion of the band, these slits being disposed transversely of the band and being of a length approximating the width of the strap 12. The strap 12 is projected through the slits 22 to form transverse, opposed loops 24–26 spaced apart to accept lateral retaining pins of a wrist watch.

Figure 4:
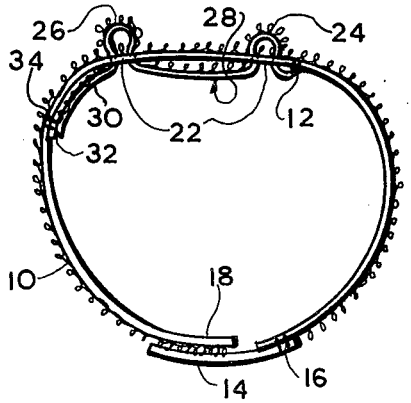
FIG. 4 is a side elevational view of the watchband disposed as in use.

The intervening stretch 28 of the strap 12, between the loops 24–26, in use, lies flat against the band as indicated in FIG. 4. The terminal portion 30 of the strap 12 is secured by the tab 32 which as illustrated is secured to the band as at 34. The tab 32 as illustrated has myriad superficial hooks to interconnect with the myriad loop-like eyes on the terminal 30.

It will be evident from the foregoing that the strap can be intentionally disconnected from the tab 32 and manipulated to remove and/or replace a wrist watch from the watchband without removal of the watch retaining pins from the wrist watch. It will also be evident that the watchband described supra can be packaged and shipped with the strap 12 laid substantially flat upon the band 10 to save space and enable a simple envelope container to be used. Furthermore it will be noted that in manufacturing this watchband only two simple transverse attachments are required, that the slits 22 are very easily made, and that no buckles or rings are required.

What is claimed as new and desired to be secured by Letters Patent is:

1. An insulative wide style watchband, comprising:

(a) an elongated band of electrically insulative material with one end portion having a first type of fastener means and the other end portion having a second type of mating fastener means so that said end portions are capable of releasible interlocking engagement to form a bracelet;

(b) said band having a pair of transverse opposed openings intermediate said end portions and spaced apart longitudinally of the band;

(c) strap structure of a width less than the width of said band, secured to said band and having portions thereof extending through said openings in the form of spaced opposed loops capable of receiving the lateral retaining pins of a wrist watch; and (d) said strap having permanent securing means at one end thereof and easily releasible securing means at the other end of the strap, so that lateral retaining pins of a wrist watch need not be removed from the watch in mounting and/or removal of a wrist watch on or from the watchband.

2. A watchband according to claim 1 wherein said releasible means includes a tab secured to said band and capable of releasible interlocking engagement with said strap on the side of the band remote from said spaced opposed loops.

* * * * *